US005713262A

United States Patent [19]

Sugiyama et al.

[11] Patent Number: 5,713,262

[45] Date of Patent: Feb. 3, 1998

[54] ENGINE PISTON HAVING A RECESS DEFINED IN THE LOWER SURFACE OF THE HEAD

[75] Inventors: Masanori Sugiyama, Aichi-ken; Yoshihiko Masuda, Okazaki, both of Japan

[73] Assignee: Toyota Jidosha Kabushiki Kaisha, Toyota, Japan

[21] Appl. No.: 661,247

[22] Filed: Jun. 10, 1996

[30] Foreign Application Priority Data

Jun. 12, 1995 [JP] Japan ..... 7-144573

[51] Int. Cl.[6] ..... F01B 31/00

[52] U.S. Cl. ..... 92/158; 92/237; 92/238; 92/157

[58] Field of Search ..... 92/158, 159, 160, 92/237, 157, 238; 123/193.6

[56] References Cited

U.S. PATENT DOCUMENTS

| | | | |
|---|---|---|---|
| 3,319,535 | 5/1967 | Holcombe . | |
| 3,403,605 | 10/1968 | Schmidt | 92/237 |
| 4,161,165 | 7/1979 | Belush | 123/193.6 |
| 4,715,267 | 12/1987 | Richmond | 92/237 |
| 4,752,995 | 6/1988 | Collyear | 92/237 |
| 4,817,505 | 4/1989 | Rhodes | 92/237 |
| 5,076,226 | 12/1991 | Watanabe et al. | 92/158 |
| 5,174,249 | 12/1992 | Katou . | |

FOREIGN PATENT DOCUMENTS

| | | |
|---|---|---|
| A-214685 | 3/1987 | European Pat. Off. . |
| A-2323022 | 4/1977 | France . |
| C-639234 | 12/1936 | Germany . |
| B-1106556 | 12/1957 | Germany . |
| 62-128144 U | 8/1987 | Japan . |
| 3-27856 U | 3/1991 | Japan . |
| 5-172001A | 7/1993 | Japan . |

OTHER PUBLICATIONS

Automobile Technical Information Publication No. 93626, published Dec. 6, 1993, p. 169.

*Primary Examiner*—Thomas E. Denion
*Attorney, Agent, or Firm*—Kenyon & Kenyon

[57] ABSTRACT

A piston, which reciprocates in a cylinder bore of an engine, is supplied with lubricating oil. The piston includes pin bosses provided under a piston head, a symmetrical pair of skirts, and side walls connecting the pin bosses and the skirts. The side walls have openings, which communicate the outer side of the walls with the inner side of the walls under the middle section of the head. A recess is defined in the lower surface of the head to receive a spray of lubricating oil. The width of the recess is wider than the width of each skirt at its basal portion. This causes the oil supplied to the lower surface of the head during movement of the piston to be injected against the recess and thus be diffused. As a result, oil passes by the basal section of the skirts and permeates into the space defined by the cylinder bore and the skirts.

16 Claims, 4 Drawing Sheets

ENGINE PISTON HAVING A RECESS DEFINED IN THE LOWER SURFACE OF THE HEAD

BACKGROUND OF THE INVENTION

1. Field of the Invention

The present invention relates to an engine piston, and more particularly, to a piston that receives a spray of oil on its lower surface and deflects the spray to a desired location.

2. Description of the Related Art

In a conventional engine, pistons that reciprocate in cylinder bores expand due to the high temperature of the heat produced in combustion chambers. Overheating of the pistons lowers the knock limit value with respect to the ignition timing of the air-fuel mixture in the combustion chamber. In addition, excessive heat expansion of each piston increases friction produced between the piston and the cylinder bore. To solve these problems, pistons are cooled by injecting lubricating oil toward the lower surface of the piston's head with an oil supplying device such as an oil jet provided in the engine.

During recent years, modifications made in the shape of pistons has contributed to reducing the weight of engines. Japanese Unexamined Patent Publication 5-172001 discloses such a uniquely shaped piston together with its improved cooling structure. As shown in FIG. 7, the publication describes a piston 31 that includes a pin boss 33 and skirts 34, which are provided below a piston head 32 and connected to one another by side walls 35. The piston 31 has a hollowed section 36 below the head 32 that contributes to a light weight structure. The section 36 includes first and second passages 37, 38. The first passage 37 is defined about the boss 33 to allow passage of lubricating oil and is connected with the section 36. The second passage 38 allows passage of oil directed downward of the piston 37. When lubricating oil is supplied to the lower side of the head 32, the oil cools the head 32 and then flows through the first passage 37 to cool the boss 33, side walls 35, and cylinder bore (not shown). The oil then passes through the second passage 38 and flows downward of the piston 31.

However, although the above structure of the piston 31 enables some of the oil supplied to the lower side of the head 32 to be conveyed to the cylinder bore through the hollow section 36, the oil is not positively provided to the space between the cylinder bore and the skirts 34. As a result, the oil supplied between the skirts 34 and the bore is insufficient.

SUMMARY OF THE INVENTION

Accordingly, it is a primary objective of the present invention to provide an engine piston that improves the sliding performance of a skirt by positively providing lubricating oil, supplied to the lower side of the head, to a space between the skirt and the cylinder bore.

To achieve the foregoing and other objects and in accordance with the purpose of the present invention, an engine piston adapted to be reciprocally fitted in a cylinder bore of an engine is provided. The piston is arranged to receive lubricant oil from an oil supply device and has a head, a pair of pin bosses, a pair of skirts and a pair of side walls. The pin bosses, the skirts and the walls are arranged in association with one another. The pin bosses are coaxially arranged with each other under the head. The skirts extends from a lower surface of the head in a symmetrical manner with respect to an axis of the bosses. The skirts are arranged to move along the cylinder bore. The each of the side walls provides a connection with the associated pin boss and the associated skirt. The lower surface receives the lubricant oil. The piston comprises a recess formed in the lower surface to receive the lubricant oil. The recess has a width as measured in the axial direction of the bosses. The skirts have a width as measured in the axial direction of the bosses such that the width of the skirts is smaller than the width of the recess.

BRIEF DESCRIPTION OF THE DRAWINGS

The features of the present invention that are believed to be novel are set forth with particularity in the appended claims. The invention, together with objects and advantages thereof, may best be understood by reference to the following description of the presently preferred embodiments together with the accompanying drawings in which:

DETAILED DESCRIPTION OF THE PREFERRED EMBODIMENT

Figure 1:
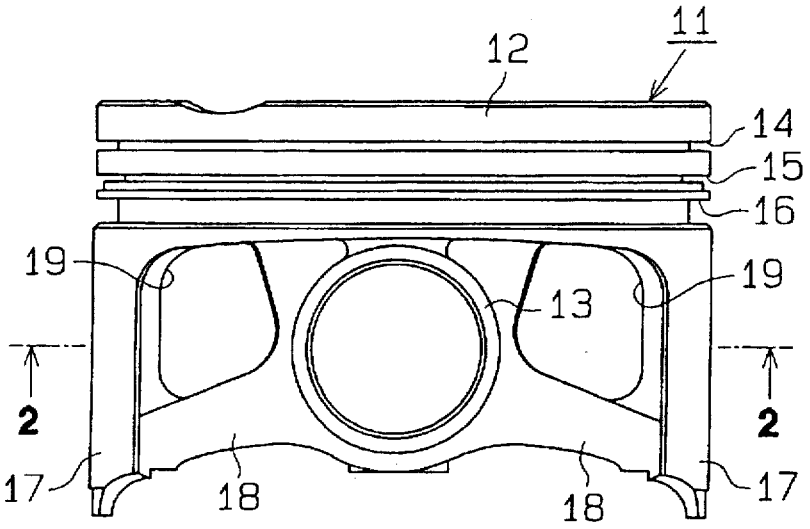
FIG. 1 is a front view showing a piston.
Figure 2:
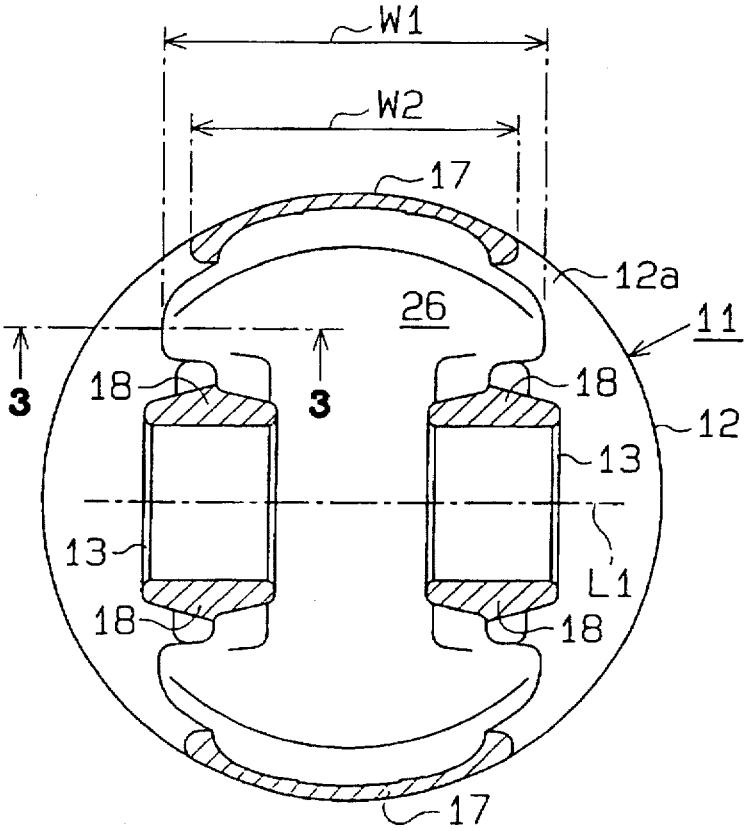
FIG. 2 is a cross-sectional view taken along line 2—2 of FIG. 1.
Figure 3:
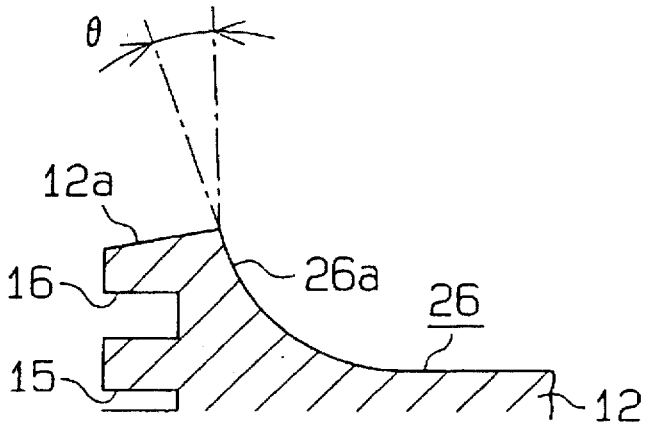
FIG. 3 is a cross-sectional view taken along line 3—3 of FIG. 2.

FIG. 1 shows a front view of a piston 11. FIG. 2 shows a cross-sectional view taken along line 2—2 of FIG. 1, and FIG. 3 shows a cross-sectional view taken along line 3—3 of FIG. 2. The piston 11 includes a substantially disk-shaped head 12 and a pair of pin bosses 13 provided under the head 12. Three ring grooves 14, 15, 16 extending parallel to one another are provided in the peripheral surface of the head 12. The pair of bosses 13 are arranged along the same axis L1. A piston ring is arranged in each of the grooves 14, 15 and an oil ring is arranged in the groove 16.

The bosses 13 are opened toward the front and rear sides of the piston 11. A piston pin 22 (shown in FIG. 5) is arranged in the two bosses 13. A pair of skirts 17 are arranged symmetrically about the axis L1 of the two bosses 13 and extend downward along the outer periphery of the head 12. The two skirts 17 have identical shapes. Under the head, side walls 18 are arranged around the bosses 13 and connect the bosses 13 to the skirts 17. The side walls 18 have openings 19, which communicate the outer side of the walls 18 with the inner side of the walls 18 under the middle section of the head 12. The openings 19, which are opposed to each other in the direction of the axis L1, are also communicated with each other.

Figure 4:
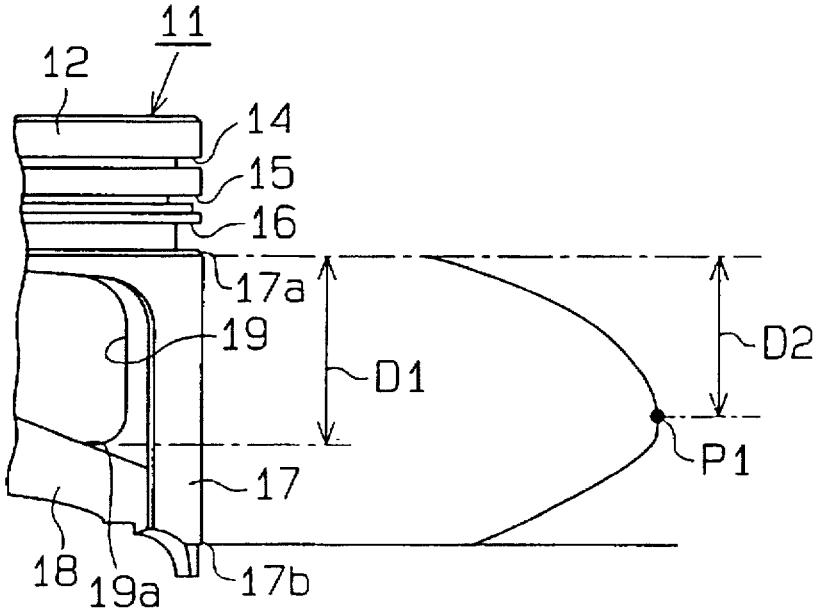
FIG. 4 is an exaggerated view of the barrel profile of the skirt.

FIG. 4 shows an exaggerated barrel profile of the skirt 17. The skirt 17 has an upper end 17*a* located at the boundary, a lower end 17*b* opposed to said upper end. The skirt 17 has a barrel profile, which is projected most outwardly at its vertically middle section. At peak P1, where the skirt 17 projects most outwardly, the clearance between the skirt 17 and the cylinder bore is smallest. Thus, the pressure acting on the surface of the skirt 17, or the planar pressure acting on the skirt 17, is highest at peak P1. The peak P1 extends around the circumference of the skirt 17. Distance D1, which is the length from the upper end 17*a* of the skirt 17 to the bottom 19*a* of the opening 19 in the vertical direction, is equal to or longer than distance D2, which is the length from the upper end 17*a* to the peak P1 in the vertical direction. That is, the bottom 19*a* is arranged at a height equal to or lower than the peak P1.

Figure 5:
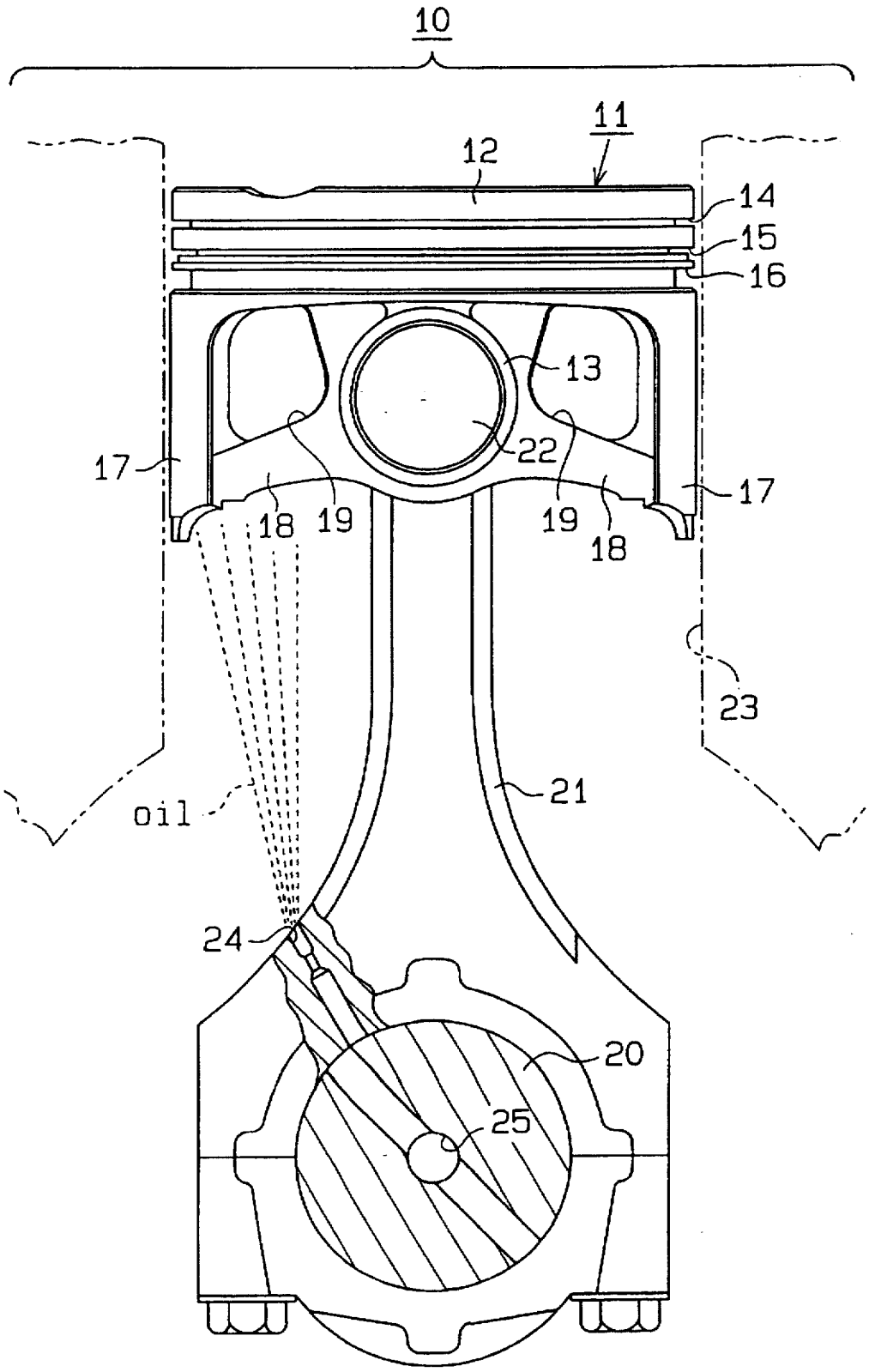
FIG. 5 is an assembling drawing showing the piston in a cylinder bore.

The piston 11 is employed in an engine. As shown in FIG. 5, the piston 11 is connected to a connecting rod 21, which is connected to a crankshaft 20, by the piston pin 22. The piston 11 is installed in a cylinder bore 23, which is formed in the engine 10. The piston 11 reciprocates along the walls of the bore 23 when the engine 10 is operated. Lubricating oil under a predetermined pressure is supplied to an oil passage 25 of the crankshaft 20 and injected from an oil nozzle 24, provided in the connecting rod 21, toward the piston 11 and bore 23 during operation of the engine 10. The oil directed toward the piston 11 is injected against a lower surface 12*a* of the head 12 between the two skirts 17.

As shown in FIG. 2, the lower surface 12*a* has a recess 26 where the oil is received. The shape of the recess 26 is symmetrical with respect to the axis L1. The recess 26 receives and diffuses the injected oil. As shown in FIG. 3, the recess 26 is obtained by hollowing out a portion of the lower surface 12*a* of the head 12. The peripheral wall of the recess 26 has a smoothly curved cross section which defines a curved surface 26*a*. A predetermined angle θ is defined between a line extending outward from the curved surface 26*a* and a axis of the head 12. In this embodiment, the value of the angle θ is equal to or larger than 10 degrees.

As shown in FIG. 2, width W1, which corresponds to the width of the recess 26 in the direction of the axis L1, is larger than the width W2, which corresponds to the width of the skirt 17 at the vicinity of its basal portion in the direction of the axis L1. That is, the distance between the two outer ends of the recess 26 is longer than the distance between the two basal outer ends of the skirt 17 on each side of the axis L1.

Accordingly, the above structure allows lubricating oil to be injected from the oil nozzle 24 toward the piston 11 when the piston 11 reciprocally moves along the walls of the cylinder bore 23 during the operation of the engine 10. The oil is diffused when it is injected against the recess 26 defined in the lower surface 12*a* of the head 12. During the diffusion, the curved surface 26*a* of the recess 26 and its angle θ enables the oil to be efficiently diffused outward. The diffused oil is applied to the pin bosses 13 and the inner side of the skirts 17. The oil is also applied to the cylinder bore 23 when it passes through the openings 19 in a direction parallel to the axis L1 of the bosses 13. Therefore, the oil diffused by the recess 26 is efficiently applied to the various components of the piston 11 under the head 12 and thus efficiently cools the piston 11.

In addition, some of the oil diffused by the recess 26 passes by the basal portion of the skirts 17 and is applied to the cylinder bore 23 thus permeating into the space defined between the bore 23 and the skirts 17. Since oil is positively supplied to the space defined between the bore 23 and the skirts 17, a sufficient amount of oil is applied between the bore 23 and skirts 17 in an efficient manner. This further improves the lubrication and sliding performance of the skirts 17. The improvement in the sliding ability enables a further reduction in the area of the skirts 17. The increase in the amount of oil supplied between the skirts 17 and the bore 23 results in an improvement in the prevention of scuffing of the piston 11. Furthermore, since the oil film formed between the skirts 17 and the bore 23 is relatively thick, the film serves as a damper and suppresses slapping between the skirt 17 and the bore 23.

The recess 26 defined in the lower surface 12*a* of the head 12 and the openings 19 in the side walls 18 contribute to a further reduction in the weight of the piston 11.

Additionally, the bottom of the opening 19 is arranged at a height equal to or lower than the peak P1 on the barrel profile of the skirts 17. The clearance between the skirts 17 and the bore 23 is minimum at the height corresponding to the peak P1. The pressure on the outer peripheral surface of the skirts 17 where the skirts 17 are connected to the side walls 18 is greater than that at other parts of the skirts 17 at the same height. The region where the pressure is the highest, or the peak P1, and the regions where the side walls 18 causes the pressure to be high do not overlap each other. This enables the value of the maximum pressure at the region corresponding to the peak P1 to be uniformly maintained around the circumference of the skirts 17 despite the existence of the side walls 18. It is required to uniformly maintain the planar pressure at peak P1 about the circumference of the skirts 17. In other words, the side walls 18 do not cause the value of the maximum pressure at the region corresponding to the peak P1 to vary. As a result, the distance between the opposed side walls 18 is shortened in the direction of the axis L1. This, in turn, allows the width W2 of each skirt 17 to be narrowed. The narrowing of the width W2 of each skirt 17 increases the difference between the width W1 of the recess 26 and width W2. This allows a larger amount of lubricating oil, injected toward the lower side of the piston 11, to be supplied between the skirts 17 and the cylinder bore 23.

Although only one embodiment of the present invention has been described so far, it should be apparent to those skilled in the art that the present invention may be embodied in many other specific forms without departing from the spirit or scope of the invention. Particularly, it should be understood that the present invention may also be modified as described below. Such modifications achieve the same operation and effects of the above embodiment.

Figure 6:
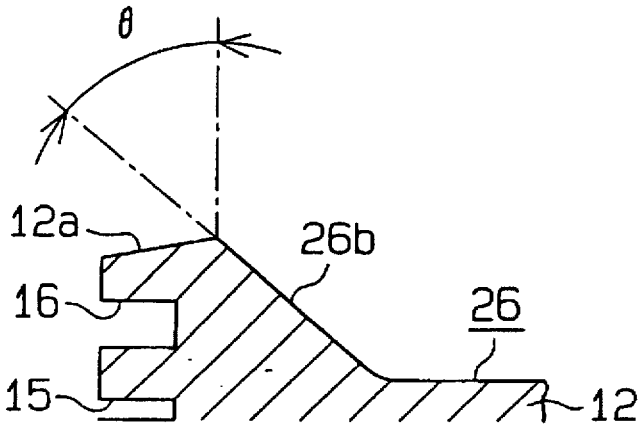
FIG. 6 is a cross-sectional view based on FIG. 3.
Figure 7:
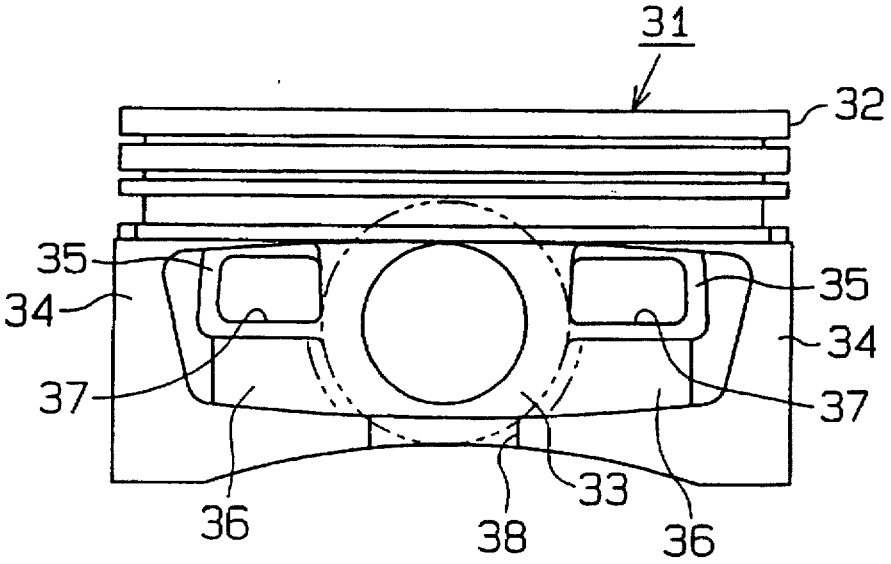
Fig. 7 (Prior Art)
FIG. 7 is a front view of a prior art piston.

In the above embodiment, the peripheral area of the recess 26 has a smoothly curved surface 26*a* which extends outwardly at a predetermined angle θ with respect to the axis of the head 12, as shown in FIG. 3. However, as shown in FIG. 6, the peripheral area of the recess 26 may have an inclined conical surface 26*b* that extends outwardly at a predetermined angle θ with respect to the axis of the head 12.

In the first embodiment, the oil nozzle 24, which supplies lubricating oil to the lower side of the piston 11, was provided in the connecting rod 21. However, an oil jet that supplies oil to the lower side of the piston 11 may be provided separately from the connecting rod 24.

The piston 11 employed in the first embodiment has three grooves 14–16. However, the present invention may be embodied in a piston having more or less than three grooves.

Although the pair of skirts 17 have an identical shape in the first embodiment, skirts having different shapes may be used.

In the first embodiment, the shape of the recess 26 is symmetrical about the axis L1 of the pin bosses 13. However, a recess having a shape which is not symmetrical may be used instead.

Therefore, the present examples and embodiments are to be considered as illustrative and not restrictive and the invention is not to be limited to the details given herein, but may be modified within the scope of the appended claims.

What is claimed is:

1. An engine piston adapted to be reciprocally fired in a cylinder bore of an engine, said piston being arranged to receive lubricant oil from an oil supply means and having a head, a pair of pin bosses, a pair of skirts and a pair of side walls, wherein said pin bosses, said skirts and said walls are arranged in association with one another, said pin bosses being coaxially arranged with each other under the head, said skirts extending from a lower surface of the head in a symmetrical manner with respect to an axis of the bosses, wherein said skirts are arranged to move along the cylinder bore, and wherein each of the side walls provides a connection with the associated pin boss and the associated skirt, and wherein said lower surface receives the lubricant oil, said piston comprising:

a recess formed in said lower surface to receive the lubricant oil, said recess having a width as measured in the axial direction of the bosses and said skirts having a width as measured in the axial direction of the bosses such that the width of the skirts is smaller than the width of the recess; and each of said side walls having an outer side, an inner side, and an opening connecting said outer side with said inner side.

2. An engine piston adapted to be reciprocally fitted in a cylinder bore of an engine, said piston being arranged to receive lubricant oil from an oil supply means and having a head, a pair of pin bosses, a pair of skirts and a pair of side walls, wherein said pin bosses, said skirts and said walls are arranged in association with one another, said pin bosses being coaxially arranged with each other under the head, said skirts extending from a lower surface of the head in a symmetrical manner with respect to an axis of the bosses, wherein said skirts are arranged to move along the cylinder bore, and wherein each of the side walls provides a connection with the associated pin boss and the associated skirt, and wherein said lower surface receives the lubricant oil, said piston comprising:

a recess formed in said lower surface to receive the lubricant oil, said recess having a width as measured in the axial direction of the bosses and said skirts having a width as measured in the axial direction of the bosses such that the width of the skirts is smaller than the width of the recess, wherein said recess has a peripheral wall, said peripheral wall including smoothly curved surface defining a predetermined inclined angle with respect to the axis of the head; and each of said side walls having an outer side, an inner side, and an opening connecting said outer side with said inner side.

3. The piston according to claim 2, wherein said engine includes a crankshaft which is rotatable and a connecting rod for connecting the pin bosses to the crankshaft.

4. The piston according to claim 3, wherein said crankshaft includes an oil passage to receive the oil under a predetermined pressure, and wherein said oil supplying means includes an oil nozzle provided on the connecting rod to inject the oil supplied to the oil passage toward the lower surface of the piston.

5. The piston according to claim 4, wherein said recess has a shape symmetrical with respect to the axis of the pin bosses.

6. The piston according to claim 5, wherein said inclined angle is at least 10 degrees.

7. The piston according to claim 6, wherein each of said skirts has an upper end located at a juncture between the skirt and the head, a lower end opposed to said upper end and a barrel profile provided between the upper end and the lower end which has a part that projects most radially outward at an axially middle section of the skirts and wherein each of said walls has an opening, and each of said openings has a lower extent, which is located furthest from the head such that a first distance is defined as the distance between the upper ends of the skirts and the lower extent of the opening as measured in the axial direction of the head, and a second distance is defined as the distance between the upper ends of the skirts and the most radially projecting part as measured in the axial direction of the head, and wherein the second distance is shorter than the first distance.

8. The piston according to claim 7, wherein each skirt has a shape that is identical to the other.

9. The piston according to claim 2, wherein said inclined angle is at least 10 degrees.

10. The piston according to claim 2, wherein said recess has a shape that is symmetrical with respect to the axis of the pin bosses, and wherein side skirts have shapes that are identical to each other.

11. The piston according to claim 10 wherein said inclined angle is at least 10 degrees.

12. The piston according to claim 2, wherein said recess has a shape that is symmetrical with respect to the axis of the pin bosses, and wherein said inclined angle is at least 10 degrees.

13. An engine piston adapted to be reciprocally fitted in a cylinder bore of an engine, said piston being arranged to receive lubricant oil from an oil supply means and having a head, a pair of pin bosses, a pair of skirts and a pair of side walls, wherein said pin bosses, said skirts and said walls are arranged in association with one another, said pin bosses being coaxially arranged with each other under the head, said skirts extending from a lower surface of the head in a symmetrical manner with respect to an axis of the bosses, wherein said skirts are arranged to move along the cylinder bore, and wherein each of the side walls provides a connection with the associated pin boss and the associated skirt, and wherein said lower surface receives the lubricant oil, said piston comprising:

a recess formed in said lower surface to receive the lubricant oil, said recess having a width as measured in the axial direction of the bosses and said skirts having a width as measured in the axial direction of the bosses such that the width of the skirts is smaller than the width of the recess, wherein said recess has a peripheral wall, said peripheral wall including inclined surface defining a predetermined inclined angle with respect to the axis of the head; and each of said side walls having an outer side, an inner side, and an opening connecting said outer side with said inner side.

14. An engine piston adapted to be reciprocally fitted in a cylinder bore of an engine, said piston being arranged to receive lubricant oil from an oil supply means and having a head, a pair of pin bosses, a pair of skirts and a pair of side walls, wherein said pin bosses, said skirts and said walls are arranged in association with one another, said pin bosses being coaxially arranged with each other under the head, said skirts extending from a lower surface of the head in a symmetrical manner with respect to an axis of the bosses, wherein said skirts are arranged to move along the cylinder bore, and wherein each of the side walls provides a connection with the associated pin boss and the associated skirt, and wherein said lower surface receives the lubricant oil, said piston comprising:

a recess formed in said lower surface to receive the lubricant oil, said recess having a width as measured in the axial direction of the bosses and said skirts having a width as measured in the axial direction of the bosses such that the width of the skirts is smaller than the width of the recess, wherein each of said skirts has an upper end located at a juncture between the skirt and the head, a lower end opposed to said upper end and a barrel profile provided between the upper end and the lower end which has a part that projects most radially outward at an axially middle section of the skirt, and wherein each of said walls has an opening, and each of said openings has a lower extent, which is located furthest from the head such that a first distance is defined as the distance between the upper ends of the skirts and the lower extent of the opening as measured in the axial direction of the head, and a second distance is defined as the distance between the upper ends of the skirts and the most radially projecting part as measured in the axial direction of the head, and wherein the second distance is shorter than the first distance.

15. An engine piston adapted to be reciprocally fitted in a cylinder bore of an engine, said piston being arranged to receive lubricant oil from an oil supply means and having a head, a pair of pin bosses, a pair of skirts and a pair of side walls, wherein said pin bosses, said skirts and said walls are arranged in association with one another, said pin bosses being coaxially arranged with each other under the head, said skirts extending from a lower surface of the head in a symmetrical manner with respect to an axis of the bosses, wherein said skirts are arranged to move along the cylinder bore, and wherein each of the side walls provides a connection with the associated pin boss and the associated skirt, and wherein said lower surface receives the lubricant oil, said piston comprising:

a recess formed in said lower surface to receive the lubricant oil, said recess having a width as measured in the axial direction of the bosses and said skirts having a width as measured in the axial direction of the bosses such that the width of the skirts is smaller than the width of the recess, wherein said engine has a crankshaft which is rotatable and a connecting rod for connecting the pin bosses to the crankshaft, said crankshaft includes an oil passage to receive the oil under a predetermined pressure, and wherein said oil supplying means includes an oil nozzle provided on the connecting rod to inject the oil supplied to the oil passage toward the lower surface of the piston.

16. An engine piston adapted to be reciprocally fitted in a cylinder bore of an engine, said piston being arranged to receive lubricant oil from an oil supply means and having a head, a pair of pin bosses, a pair of skirts and a pair of side walls, wherein said pin bosses, said skirts and said walls are arranged in association with one another, said pin bosses being coaxially arranged with each other under the head, said skirts extending from a lower surface of the head in a symmetrical manner with respect to an axis of the bosses, wherein said skirts are arranged to move along the cylinder bore, and wherein each of the side walls provides a connection with the associated pin boss and the associated skirt, and wherein said lower surface receives the lubricant oil, said piston comprising:

a recess formed in said lower surface to receive the lubricant oil, said recess having a width as measured in the axial direction of the bosses and said skirts having a width as measured in the axial direction of the bosses such that the width of the skirts is smaller than the width of the recess, wherein said recess has a shape that is symmetrical with respect to the axis of the pin bosses; and each of said side walls having an outer side, an inner side, and an opening connecting said outer side with said inner side.

* * * * *

UNITED STATES PATENT AND TRADEMARK OFFICE

CERTIFICATE OF CORRECTION

PATENT NO. : 5,713,262

DATED : 3 February 1998

INVENTOR(S) : Masanori SUGIYAMA et al.

It is certified that error appears in the above-indentified patent and that said Letters Patent is hereby corrected as shown below:

| Column | Line | |
|---|---|---|
| 3 | 19 | Change "oil.As" to --oil. As--. |
| 4 | 63 | Change "fired" to --fitted--. |
| 5 | 64 | Change "skirts" to --skirt,--. |
| 6 | 15 | After "**10**" insert --,--. |

Signed and Sealed this

Thirtieth Day of June, 1998

*Attest:*

*Attesting Officer*

Bruce Lehman

BRUCE LEHMAN

*Commissioner of Patents and Trademarks*